US008118573B2

(12) United States Patent
Alaze

(10) Patent No.: US 8,118,573 B2
(45) Date of Patent: Feb. 21, 2012

(54) PISTON PUMP WITH AT LEAST ONE PISTON ELEMENT

(75) Inventor: Norbert Alaze, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 1138 days.

(21) Appl. No.: 11/721,983

(22) PCT Filed: Dec. 14, 2005

(86) PCT No.: PCT/EP2005/056773

§ 371 (c)(1),
(2), (4) Date: Jun. 18, 2007

(87) PCT Pub. No.: WO2006/067076

PCT Pub. Date: Jun. 29, 2006

(65) Prior Publication Data

US 2009/0269230 A1 Oct. 29, 2009

(30) Foreign Application Priority Data

Dec. 22, 2004 (DE) ..... 10 2004 061 813

(51) Int. Cl.
*F04B 11/00* (2006.01)

(52) U.S. Cl. ..... 417/540; 417/521

(58) Field of Classification Search ..... 417/540–542, 417/522

See application file for complete search history.

(56) References Cited

U.S. PATENT DOCUMENTS

| | | | | |
|---|---|---|---|---|
| 1,676,114 | A * | 7/1928 | Rusdell | 417/262 |
| 2,430,723 | A * | 11/1947 | Lupfer | 417/343 |
| 3,809,507 | A * | 5/1974 | Baglai | 417/488 |
| 4,514,151 | A * | 4/1985 | Anders et al. | 417/540 |
| 4,643,651 | A * | 2/1987 | Couillard | 417/265 |
| 4,887,870 | A * | 12/1989 | Siegel | 303/116.4 |
| 5,129,427 | A * | 7/1992 | White et al. | 138/30 |
| 5,314,315 | A * | 5/1994 | Tcholakov | 417/540 |
| 5,984,651 | A * | 11/1999 | Beck et al. | 417/503 |
| 6,086,336 | A * | 7/2000 | Welschof et al. | 417/308 |
| 6,116,871 | A * | 9/2000 | Backe et al. | 417/540 |
| 6,488,487 | B2 * | 12/2002 | Minato | 417/540 |

FOREIGN PATENT DOCUMENTS

| | | |
|---|---|---|
| DE | 1703210 | 1/1972 |
| DE | 10251342 A1 | 5/2004 |
| GB | 1249984 | 10/1971 |
| JP | 5975377 U | 5/1984 |
| JP | 181761 U | 5/1989 |
| JP | 3186463 A | 8/1991 |

(Continued)

*Primary Examiner* — Devon C Kramer
*Assistant Examiner* — Amene Bayou
(74) *Attorney, Agent, or Firm* — Ronald E. Greigg

(57) ABSTRACT

A piston pump having a piston longitudinally movable in a housing. A first pressure chamber is delimited by the piston element and a component affixed to the housing. The first pressure chamber is connected to a suction region via an inlet valve and is operationally connected to a delivery side via an outlet valve. A compensation piston unit has a working piston chamber connected to the delivery side. A stroke volume of the first pressure chamber is twice the size of a stroke volume of the working piston chamber. The piston element and a component affixed to the housing delimit a second pressure chamber connected to the suction region which is operationally connected to the first pressure chamber during a suction stroke of the piston element whose volume varies by half the stroke volume of the first pressure chamber and expands with a delivery stroke of the piston element.

9 Claims, 3 Drawing Sheets

FOREIGN PATENT DOCUMENTS

| | | | |
|---|---|---|---|
| JP | 10281055 | A | 10/1998 |
| JP | 2000314373 | A | 11/2000 |
| JP | 2003500610 | A | 1/2003 |
| WO | 0181761 | A1 | 11/2001 |
| WO | WO 0181761 | A1 * | 11/2001 |

* cited by examiner

PISTON PUMP WITH AT LEAST ONE PISTON ELEMENT

CROSS-REFERENCE TO RELATED APPLICATION

This application is a 35 USC 371 application of PCT/EP2005/056773 filed on Dec. 14, 2005.

BACKGROUND OF THE INVENTION

1. Field of the Invention

The invention relates to a piston pump with at least one piston element, which can be driven by a drive unit and is situated in a longitudinally moving fashion inside a housing.

2. Description of the Prior Art

WO 01/81761 A1 has disclosed a piston pump with two piston elements that can be driven by a drive unit and are situated in a longitudinally moving fashion inside a housing. Together with a housing, the piston elements each define a respective pressure chamber whose volume varies as a function of a piston movement. The pressure chambers are connected to both the suction side or a suction region and the pressure side or a delivery side of the piston pump; during a suction stroke of the piston elements, hydraulic fluid is drawn into the relevant pressure chamber, which is characterized by a steady volume increase, and during a delivery stroke of the piston element, hydraulic fluid is conveyed in the direction of the delivery side from the pressure chamber, which is then characterized by a steady volume decrease. In addition, the delivery side of the piston pump is respectively connected to a working piston chamber of a compensation piston unit whose compensation piston is likewise moved by the drive unit, back and forth in the longitudinal direction in the housing, between a top dead center and a bottom dead center.

In order to smooth a pressure pulsation on the delivery side of the piston pump, the piston element and the compensation piston unit corresponding to it are respectively phase shifted in relation to each other by 180° so that the compensation piston of the compensation piston unit is situated in its bottom dead center when the corresponding piston element is situated in its top dead center.

In addition, the compensation pistons are embodied as stepped in order to smooth a suction-side pressure pulsation of the two-piston pump in comparison to conventional two-piston pumps not equipped with compensation pistons. This is based on the knowledge that the suction-side delivery characteristic of a piston pump can be smoothed through the use of a so-called step-piston pump essentially to the same degree as the pressure-side delivery characteristic can be smoothed by the combination of the pump piston elements with the compensation pistons.

It is disadvantageous, however, that the piston rod, which cooperates with a cam of the drive unit, limits the effective area of the stepped compensation pistons used to smooth the suction-side pressure pulsations, in such a way that a desired smoothing of the suction-side pressure pulsation cannot be achieved to the extent desired.

SUMMARY AND ADVANTAGES OF THE INVENTION

The piston pump according to the invention is provided with at least one piston element, which can be driven by a drive unit and is situated in a longitudinally moving fashion inside a housing, and with a first pressure chamber that is delimited by the piston element and at least one component affixed to the housing, which first pressure chamber can be connected via an inlet valve device to a suction side of the piston pump, and can be brought into an operative connection with a delivery side of the piston pump via an outlet valve device. In addition, a compensation piston unit that can also be driven by the drive unit is provided, whose working piston chamber communicates with the delivery side. A stroke volume of the first pressure chamber is twice the stroke volume of the compensation piston unit.

The suction-side pressure pulsation of the piston pump according to the invention is improved in comparison to a one-piston pump known from the prior art because a second pressure chamber that is connected to the suction region of the piston pump and operationally connected to the first pressure chamber during a suction stroke of the piston element is provided, which is delimited by the piston element and at least one component affixed to the housing and whose volume varies by half the stroke volume of the first pressure chamber as a function of a movement of the piston element. The volume of the second pressure chamber expands during a delivery stroke of the piston element that decreases the volume of the first pressure chamber and contracts during a suction stroke of the piston element that increases the volume of the first pressure chamber.

As a result, by contrast with a conventional piston pump in which the stroke volume of the first pressure chamber is completely drawn out of the suction region during the suction stroke of the piston element, in the piston pump according to the invention, the stroke volume of the first pressure chamber is drawn out of the suction region halfway during the suction phase of the first pressure chamber and halfway during the delivery phase of the first pressure chamber. The half stroke volume drawn out of the suction region during the delivery phase of the piston pump according to the invention is first conveyed into the second pressure chamber and, during the suction stroke of the piston element in which the volume of the second pressure chamber is reduced by half the stroke volume of the first pressure chamber, is conveyed into the first pressure chamber.

The above-described functionality of the second pressure chamber results Trom the placement of the second pressure chamber between the suction region of the piston pump and the first pressure chamber and from the inverse volume changes of the two pressure chambers as a function of the movement of the piston element.

The second pressure chamber thus constitutes an intermediate storage space, which can be filled during the delivery phase of the first pressure chamber and is emptied during the suction phase of the first pressure chamber due to its volume reduction, discharging half the stroke volume of the first pressure chamber into said first pressure chamber. The rest of the portion of hydraulic fluid required to completely fill the first pressure chamber is drawn from the suction region of the piston pump during the suction phase of the first pressure chamber. In a simple fashion, this procedure leads to a reduction in the fluid friction in the suction region, which in turn achieves a reduced generation of noise during operation of a piston pump.

Other advantages and advantages embodiments of the subject according to the invention are disclosed.

BRIEF DESCRIPTION OF THE DRAWINGS

A preferred example of piston pumps embodied according to the invention is explained in detail in the subsequent description, taken with the accompanying drawing, in which.

DESCRIPTION OF THE PREFERRED EMBODIMENT

Figure 1:
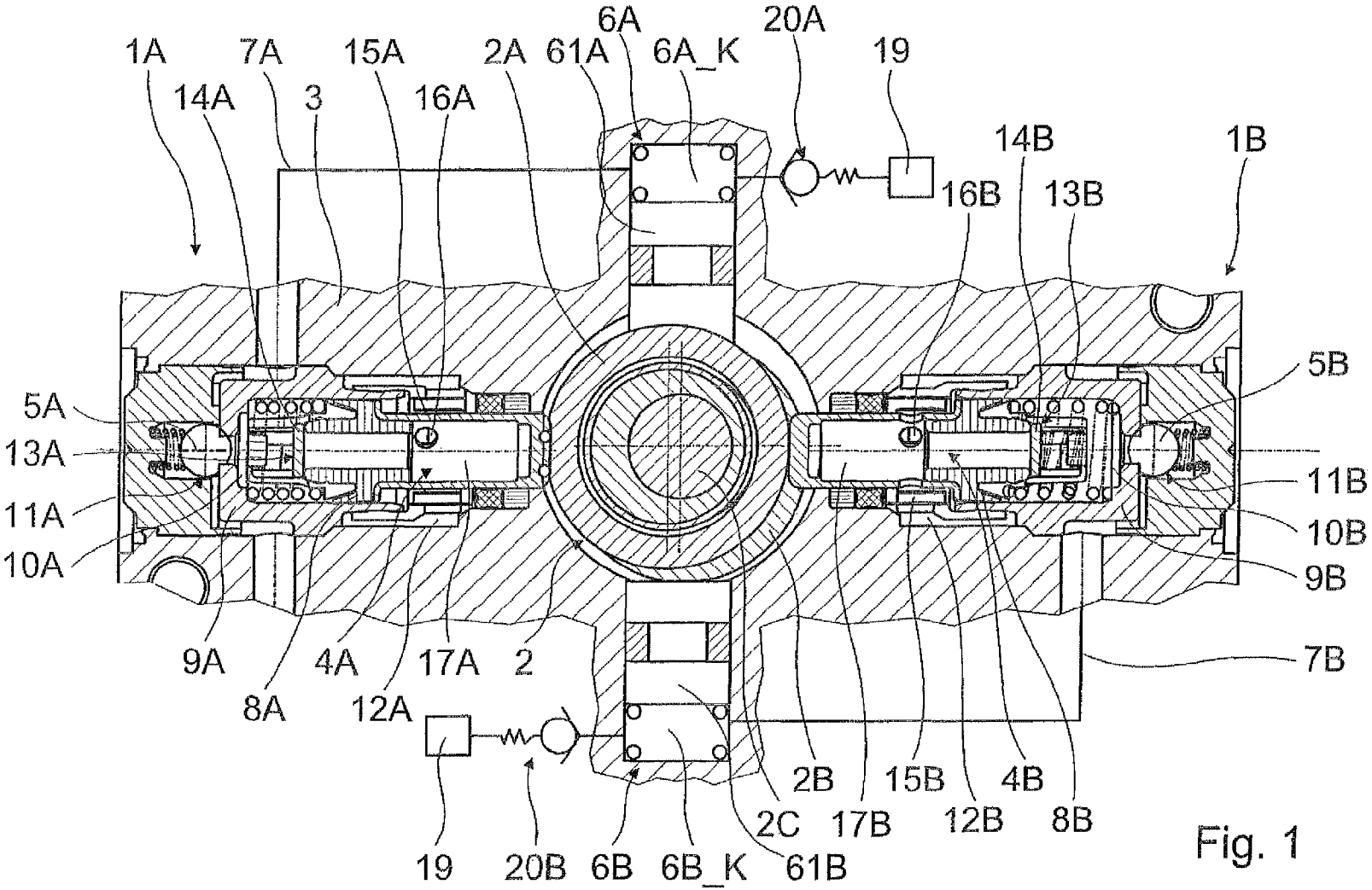
FIG. 1 shows a schematic longitudinal section through piston pumps according to the invention.

FIG. 1 shows the longitudinal section through two piston pumps 1A, 1B. Each pump is embodied in the form of one-piston, pump with a piston element 4A, 4B, that can be driven by a drive unit 2 and is situated in a longitudinally moving fashion inside a housing 3. The piston pumps 1A, 1B have basically the same design, which is why the description of the piston pumps 1A and 1B below refers to only one of the piston pumps 1A or 1B and in the drawings, parts that are the same have been provided with the same reference numerals, combined with the letter A or B.

The two pistons pumps 1A and 1B are each associated with a respective compensation piston unit 6A, 6B, while a working piston chamber 6A$_{_K}$ or 6B$_{_K}$ of the compensation piston unit 6A, 6B is connected to a respective delivery side 7A, 7B of the piston pumps 1A, 1B.

The piston element 4A of the piston pump 1A, together with two insert elements 8A, 9A affixed to the housing, delimits a first pressure chamber 10A, which can be connected via an outlet valve device 11A to the delivery side 7A of the piston pump 1A. In addition, the first pressure chamber 10A can be connected via an inlet valve device 13A to a suction region 12A of the piston pump 1A; the inlet valve device 13A closes the first pressure chamber 10A off from the suction region 12A during the delivery stroke of the piston element 4A and during a compression stroke that reduces the volume of the first pressure chamber 10A.

The outlet valve device 11A, which in the present case is embodied with a spherical sealing element 5A spring-loaded in the closing direction of the outlet valve device 11A, operates in such a way that during a delivery stroke of the piston element 4A, once a defined pressure value in the first pressure chamber 10A is achieved, the outlet valve device 11A lifts away from the insert element 9A and hydraulic fluid contained in the first pressure chamber 10A is conveyed toward the delivery side 7A of the piston pump 1A.

At the same time, the inlet valve device 13A, which is embodied with a disk-like sealing element 14A, is closed so that during the delivery stroke of the piston element 4A, the connection is interrupted between the first pressure chamber 10 and the suction region 12A.

Figure 2:
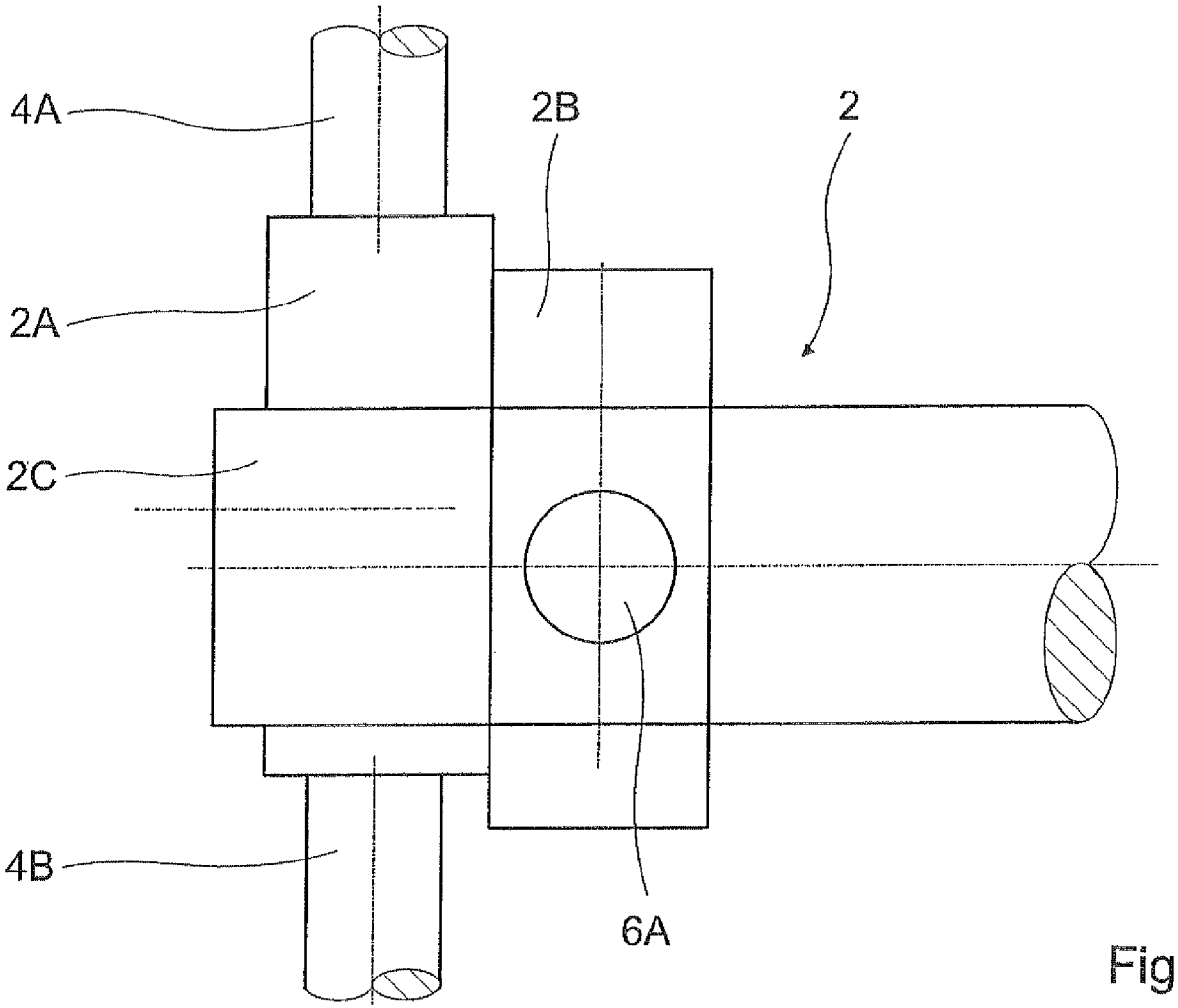
FIG. 2 shows a very schematic partial view of a drive unit of the piston pumps according to FIG. 1.

The piston elements 4A and 4B of the piston pumps 1A and 1B and the corresponding compensation piston units 6A and 6B rest with their respective end surfaces oriented toward the drive unit 2 against one of two cam elements 2A, 2B that are affixed to a drive shaft 2C of the drive unit 2 in such a way as to prevent them from rotating in relation to it. The two cam elements 2A and 2B are embodied with the same eccentricity and, in the manner shown in detail in FIG. 2, are positioned offset from each other around the circumference of the drive shaft 2C so that the compensation piston units 6A and 6B operationally connected to the cam element 2B are each triggered by the drive unit 2 with a timing that is phase-shifted by 180° from the respective corresponding piston element 4A or 4B. As a result, the compensation piston elements 61A and 61B of the compensation piston units 6A, 6B are each moved toward their respective bottom dead center while the corresponding piston element 4A or 4B is moved toward its top dead center.

The effective areas of the compensation piston elements 61A, 61B and their stroke paths in the present case are dimensioned so that the volume of the delivery side 7A or 7B in the region of a compensation piston unit 6A or 6B is increased by half the stroke volume of the first pressure chamber 10A or 10B of the piston pump 1A or 1B during the delivery phase of the piston pump 1A or 1B and is also increased by half the stroke volume of the first pressure chamber 10A or 10B during the suction phase of the piston pump 1A or 1B.

As a result, both during the delivery phase and during the suction phase of a piston pump 1A or 1B, the delivery side 7A or 7B of a piston pump 1A or 1B is acted on with half the stroke volume of the first pressure chamber 10A or 10B of the piston pump 1A or 1B, by means of which a significantly smoother pressure pulsation on the delivery side 7A or 7B is achieved in comparison to a conventional piston pump embodied in the form of one-piston pump.

In addition, in a region oriented toward the suction region 12A, the piston element 4A is embodied as stepped in such a way that between the piston element 4A and the housing 3, a second pressure chamber 15A is embodied, which is connected to the suction region 12A and whose volume varies by half the stroke volume of the first pressure chamber 10A as a function of a movement of the piston element 4A. In this connection, the volume of the second pressure chamber 15A expands during a delivery stroke of the piston element 4A that decreases the volume of the first pressure chamber 10A and contracts during a suction stroke of the piston element 4A that increases the volume of the first pressure chamber 10A.

The second pressure chamber 15A is situated between the housing 3 and an outer circumferential surface of the piston element 4A, which is embodied in the form of a hollow deep-drawn component. In addition, the second pressure chamber 15A is connected to an inner chamber 17A of the piston element 4A via at least one bore or opening 16A in the circumferential surface of the piston element 4A so that the first pressure chamber 10A is fluidically connected to the second pressure chamber 15A when the inlet valve device 13A is open.

The dimensioning and the above-described placement of the second pressure chamber 15A achieve the fact that both during a compression stroke and during a suction stroke of the piston element 4A, half the stroke volume of the piston pump 1A or first pressure chamber 10A is conveyed from the suction side toward the first pressure chamber 10A. During the suction stroke of the piston element 4A, the other half of the stroke volume to be conveyed from the second pressure chamber 15A toward the first pressure chamber 10A is used to completely fill the first pressure chamber 10A because of its volume reduction. As a result, in the vicinity of the suction region 12A, a pressure pulsation occurs that essentially corresponds to that of a two-piston pump.

This means that with both the compensation piston units 6A and 6B and the second pressure chambers 15A and 15B, it is possible on both the suction side and the delivery side to achieve the pressure pulsation of a two-piston pump by means of a piston pump embodied as a one-piston pump, i.e. without a second pump element actually being present. This advantageously reduces manufacturing costs. In addition, it is possible to use intrinsically known one-piston pumps that are embodied with a relatively low degree of complexity in the suction-side connection region to the second pressure chamber.

In addition, in comparison to conventional two-piston pumps, an improved pressure build-up dynamic is also achieved since one-piston pumps are essentially designed with larger suction cross-sections and larger inlet cross-sections.

Also, the working piston chamber 6A_K of the compensation piston unit 6A is connected to a master cylinder 19A of a vehicle brake system that is not shown in detail, in order to convey hydraulic fluid in the direction of the master cylinder 19 of the brake system in certain operating states of an ABS or ESP system.

In order to improve driving comfort, the connection between the working piston chamber 6A_K of the compensation piston unit 6A and the master cylinder 19 as well as a connection between the working piston chamber 6B_K of the compensation piston unit 6B and the master cylinder 19 are each embodied with a check valve 20A, 20B in order to deaden or ideally, to completely eliminate, a pressure pulsation in the master cylinder 19 originating from the compensation piston units 6A and 6B.

Figure 3:
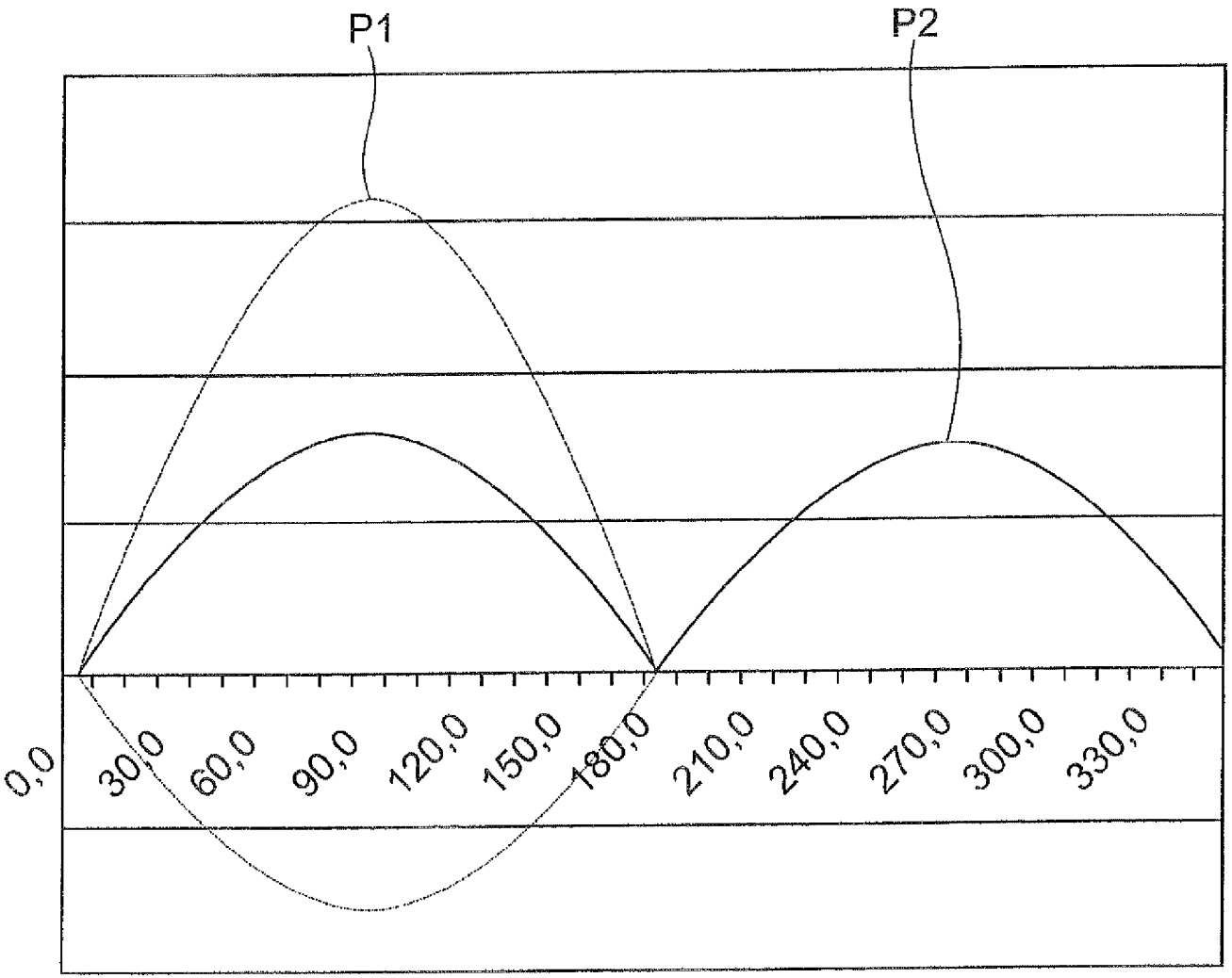
FIG. 3 shows a suction-side pressure pulsation curve of one of the piston pumps according to FIG. 1 in comparison to a piston pump that only aspirates during the suction stroke of the piston element.

Two curves of a pressure pulsation on the delivery side 15A and 15B of the piston pump 1A and 1B are shown in FIG. 3. The dashed line P1 shows the curve of the pressure pulsation of a piston pump that is embodied in the form of a one-piston pump and is operated without an above-described compensation piston unit 6A or 6B on the delivery side. The pressure pulsation graphically depicted by the curve P2 in FIG. 3 occurs on the delivery side 7A or 7B of the piston pump 1A or 1B when it is operated with a compensation piston unit 6A or 6B in the system described above.

It is clear from the comparison of the two curves the P1 and P2 that the use of the piston pump 1A or 1B embodied according to the invention achieves a pressure pulsation that is flatter and smoothed over an operating cycle of the piston pump 1A and 1B and essentially results in a reduced operating noise due to reduced fluid friction.

The foregoing relates to a preferred exemplary embodiment of the invention, it being understood that other variants and embodiments thereof are possible within the spirit and scope of the invention, the latter being defined by the appended claims.

The invention claimed is:

1. A piston pump comprising: at least one piston element situated in longitudinally moving fashion in a housing and driven by a drive unit, a first pressure chamber, delimited by the at least one piston element and at least one component affixed to the housing, connected to a suction region of the pump via an inlet valve device and operationally connected to a delivery side of the pump via an outlet valve device, and a compensation piston unit, driven by the drive unit, having a working piston chamber connected to the delivery side of the pump, wherein the first pressure chamber of the piston pump has a stroke volume that is twice a size of a stroke volume of the working piston chamber, wherein the at least one piston element and the at least one component affixed to the housing delimit a second pressure chamber which is connected to the suction region of the pump and is operationally connected to the first pressure chamber during a suction stroke of the at least one piston element, wherein the second pressure chamber has a volume that varies by half the stroke volume of the first pressure chamber as a function of a movement of the piston element, and expands during a delivery stroke of the at least one piston element that decreases the volume of the first pressure chamber, and wherein the at least one piston element is embodied as a hollow deep-drawn component, the second pressure chamber is situated between an outer circumferential surface of the at least one piston element and the at least one component affixed to the housing and communicates with an inner chamber of the at least one piston element via at least one opening in the circumferential surface of the at least one piston element, which inner chamber is connected to the first pressure chamber via the inlet valve device.

2. The piston pump according to claim 1, wherein the drive unit is equipped with a drive shaft and at least one cam supported thereon.

3. The piston pump according to claim 1, wherein the working piston chamber of the compensation piston unit is connected to a master cylinder of a vehicle brake system.

4. The piston pump according to claim 2, wherein the working piston chamber of the compensation piston unit is connected to a master cylinder of a vehicle brake system.

5. The piston pump according to claim 3, further comprising a check valve between the working piston chamber of the compensation piston unit and the master cylinder, which check valve operates in a direction from the master cylinder toward the working piston chamber and closes the connection between the master cylinder and the working piston chamber in the presence of a positive pressure difference.

6. The piston pump according to claim 4, further comprising a check valve between the working piston chamber of the compensation piston unit and the master cylinder, which check valve operates in a direction from the master cylinder toward the working piston chamber and closes the connection between the master cylinder and the working piston chamber in the presence of a positive pressure difference.

7. The piston pump according to claim 1, wherein the inlet valve device is embodied with a disk-like sealing element.

8. The piston pump according to claim 2, wherein the inlet valve device is embodied with a disk-like sealing element.

9. A piston pump comprising: at least one piston element situated in longitudinally moving fashion in a housing and driven by a drive unit, a first pressure chamber, delimited by the at least one piston element and at least one component affixed to the housing, connected to a suction region of the pump via an inlet valve device and operationally connected to a delivery side of the pump via an outlet valve device, and a compensation piston unit, driven by the drive unit, having a working piston chamber connected to the delivery side of the pump, wherein the first pressure chamber of the piston pump has a stroke volume that is twice a size of a stroke volume of the working piston chamber, wherein the at least one piston element and the at least one component affixed to the housing delimit a second pressure chamber which is connected to the suction region of the pump and is operationally connected to the first pressure chamber during a suction stroke of the at least one piston element, wherein the second pressure chamber has a volume that varies by half the stroke volume of the first pressure chamber as a function of a movement of the piston element, and expands during a delivery stroke of the at least one piston element that decreases the volume of the first pressure chamber, wherein the working piston chamber of the compensation piston unit is connected to a master cylinder of a vehicle brake system, and wherein the piston pump further comprising a check valve between the working piston chamber of the compensation piston unit and the master cylinder, which check valve operates in a direction from the master cylinder toward the working piston chamber and closes a connection between the master cylinder and the working piston chamber upon a presence of a positive pressure difference.

* * * * *